US005285800A

United States Patent [19]

Powers-McCarthy

[11] Patent Number: 5,285,800

[45] Date of Patent: Feb. 15, 1994

[54] PERMANENT WAVE APPARATUS AND PROCESS FOR CURLING HAIR

[76] Inventor: Susan Powers-McCarthy, 10150 E. Harvard Ave. E734, Denver, Colo. 80231

[21] Appl. No.: 94,371

[22] Filed: Jul. 19, 1993

[51] Int. Cl.[5] ..... A45D 7/00

[52] U.S. Cl. ..... 132/210; 132/222; 132/245; 132/248; 132/250; 132/262; 132/280

[58] Field of Search ..... 132/210, 222, 245, 248, 132/249, 250, 251, 254, 262, 264, 276, 280

[56] References Cited

U.S. PATENT DOCUMENTS

| | | | |
|---|---|---|---|
| D. 259,815 | 7/1981 | Ergaver et al. | D28/35 |
| 557,038 | 3/1896 | Wegefarth | 132/249 |
| 1,707,392 | 4/1929 | Fulton | 132/248 |
| 2,960,989 | 11/1960 | Magee | 132/262 |
| 3,297,042 | 1/1967 | Hutcheon | 132/262 |
| 3,530,863 | 9/1970 | Foster et al. | 132/222 |
| 3,543,771 | 12/1970 | Altman | 132/222 |
| 3,587,595 | 6/1971 | Popül | 132/248 |
| 3,910,290 | 10/1975 | Litman | 132/221 |
| 3,916,919 | 11/1975 | Giordano | 132/254 |
| 3,960,156 | 6/1976 | Thompson | 132/222 |
| 4,327,753 | 5/1982 | Bertschi | 132/229 |
| 4,381,790 | 5/1983 | Springer et al. | 132/242 |
| 4,989,621 | 2/1991 | Keller | 132/254 |

FOREIGN PATENT DOCUMENTS

| | | | |
|---|---|---|---|
| 461553 | 12/1991 | European Pat. Off. | 132/249 |
| 1046846 | 12/1958 | Fed. Rep. of Germany | 132/249 |

*Primary Examiner*—Gene Mancene
*Assistant Examiner*—Frank A. LaViola
*Attorney, Agent, or Firm*—William E. Hein

[57] ABSTRACT

A permanent wave apparatus for curling hair includes a perm roller having a cylindrical outer surface with four equally-spaced longitudinal rows of outwardly projecting teeth positioned thereon. As the hair strands are wrapped around the roller, the rows of teeth act to provide additional compression of the hair by pressing it more firmly together between adjacent teeth with each rotation of the roller. Thus, increased compression of the hair strands is a function of both the number of rotations or wraps of a roller and the compacting action of the hair between the roller teeth. End papers having a longitudinal I-shaped slot opening therein enhance wrapping of the hair by holding the ends of all of the hair strands in place during wrapping, thereby eliminating fish hooks or bent ends, and enabling perfect wraps, even on extemely texturized cuts. Plastic slide clips serve to secure the first roller used to wrap a given section of hair to the scalp to provide increased volume of the resulting curl at the scalp. The plastic roller clips are also used to secure subsequently wapped rollers in that section of hair to each other.

5 Claims, 1 Drawing Sheet

PERMANENT WAVE APPARATUS AND PROCESS FOR CURLING HAIR

BACKGROUND AND SUMMARY OF THE INVENTION

This invention relates generally to transfer perms employed for curling human hair and more particularly to an improved transfer perm apparatus and process which eliminates the second stage of the conventional transfer perm process in which the hair is unwrapped from a set of rods and then rewrapped onto a set of rollers that are larger in diameter than the set of rods.

Perming baby-fine hair has always presented problems. Wrapping on midsized rods with the expectation of achieving rod-sized curls usually results in the perm falling out or becoming limp prematurely. Wrapping the hair on smaller diameter rods has been found to preserve the perm for a longer period of time, but results in curls so tight that the hair can't be styled without the use of rollers or curling irons to tame frizzy, unruly ends. The prior art transfer perm process was developed to take advantage of the differences in chemical reactions that occur during each stage of a given perm process. During the initial stage, such perm processes break down the bonds of the hair fibers. The more times the hair strands can be wrapped around a perm rod, the more completely the bonds are broken. Additional wraps of the hair strands around the rod also serves to pack or compress those hair strands more tightly together. Therefore, a tighter permanent wave pattern is established, resulting in prolonged life of the perm. Following completion of the initial stage, the hair is unwrapped or taken down from the rods on which it was initially wrapped. During the second or neutralizing stage of such transfer perm processes, the hair is rewrapped onto a larger diameter roller to form looser, softer curls. While these prior art transfer perm processes produce longer-lasting, softer, looser, and more natural curls without excessively curly, frizzy ends, they are nevertheless disadvantageous in that the doublewrapping or transfer step is time consuming and subjects the fragile hair to breakage.

It is therefore the principal object of the present to provide a permanent wave apparatus and process that produces the same desirable curl characteristics as those produced by prior art transfer perms, but which eliminates the need for the second stage rewrapping of the hair.

This and other objects are accomplished in accordance with the illustrated preferred embodiment of the present invention by providing a perm roller having a cylindrical outer surface with four equally-spaced longitudinal rows of outwardly projecting teeth positioned thereon. As the hair strands are wrapped around the roller, the rows of teeth act to provide additional compression of the hair by pressing it more firmly together between adjacent teeth with each rotation of the roller. Thus, increased compression of the hair strands is a function of both the number of rotations or wraps of a roller and the compacting of the hair between the roller teeth. End papers, constructed in accordance with the present invention to include a longitudinal I-shaped slot opening, enhance wrapping of the hair by holding the ends of all of the hair strands in place during wrapping, thereby eliminating fish hooks or bend ends, and enabling perfect wraps, even on extemely texturized cuts. Plastic slide clips serve to secure the first roller used to wrap a given section of hair to the scalp to provide increased volume of the resulting curl at the scalp. The increased curl volume is a result of placement of the slide clip under or behind the curl to lift the hair strands from underneath the roller. This placement of the slide clip also results in less stress at the scalp, as well as minimizing hair breakage. The plastic slide clips are also used to secure subsequently wapped rollers in that section of hair to each other.

DETAILED DESCRIPTION OF THE PREFERRED EMBODIMENT

Figure 1:
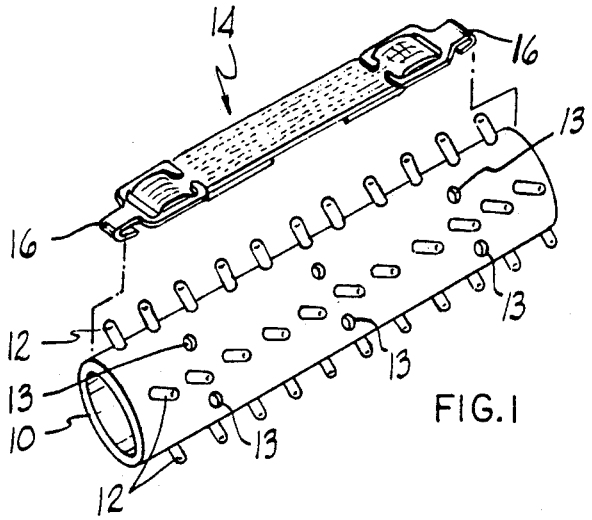
FIG. 1 is a pictorial diagram illustrating a permanent wave roller and an associated reusable elastic end guard constructed in accordance with the present invention.
Figure 2:
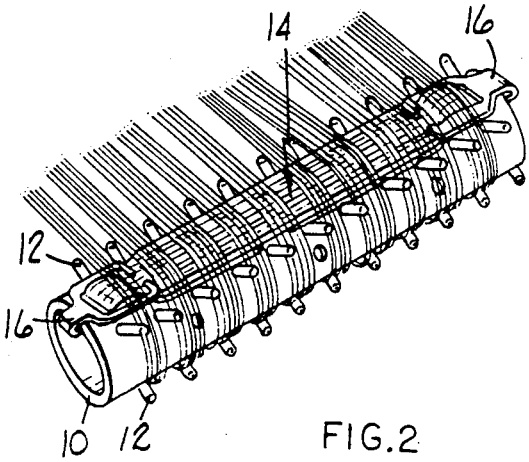
FIG. 2 is a pictorial diagram illustrating how the permanent wave roller of FIG. 1 is used to wrap hair strands and the way in which the elastic end guard is positioned over the roller after the loose ends of the hair have been placed over the roller at the beginning of a wrapping step.

Referring now to FIG. 1, there is shown a cylindrical roller 10 constructed in accordance with the present invention to include four longitudinally aligned rows of outwardly protruding teeth 12 spaced 90 degrees apart on the outer surface of the roller 10. A plurality of drainage apertures 13 are linearly arranged between the rows of teeth 12 to provide drainage of the permanent wave chemicals applied to the hair. A resusable elastic end-guard 14 having a clip 16 at each end thereof is attached to roller 10, as illustrated in FIG. 2, after the operator has placed hair ends on roller 10 at the beginning of a wrap. Rollers 10 may be provided in varying sizes to accommodate different hair textures and styling requirements. Exemplary of the sizes found to be useful are $\frac{3}{8}$, $\frac{1}{2}$, and $\frac{5}{8}$-inch diameters, for example. While other lengths may be used, rollers of three inches in length have been found to work well. Rollers 10 may also be fabricated such that the rows of teeth 12 contain different numbers of teeth to accommodate different types of hair. For example, rollers 10 having six teeth per row have been found to be useful for rolling denser, longer hair, while rollers having eleven teeth per row have been found to work best with hair that is fine to normal texture.

Figure 4:
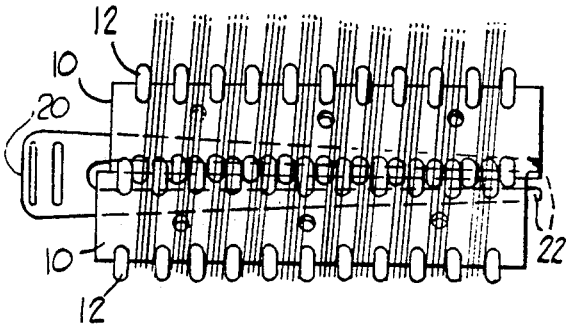
FIG. 4 is a pictorial diagram illustrating the two adjacent rollers of FIG. 3 and the position of the plastic slide clip that has been attached to the two rollers after hair has been wrapped onto them.
Figure 3:
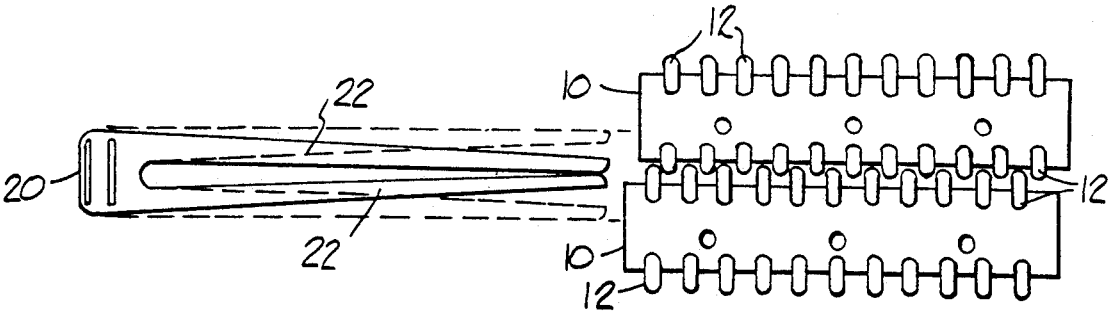
FIG. 3 is a pictorial diagram illustrating the positions of two adjacent rollers of FIG. 1 and the way in which a plastic slide clip of the present invention is attached to the two adjacent rollers.

Referring now to FIG. 3, there is shown a generally U-shaped plastic slide clip 20 having a pair of longitudinally extending clip members 22 that may be spread apart to be substantially parallel for insertion into the cylindrical cavities of two adjacent rollers 10 to maintain them in the positions shown in FIG. 4 when hair has been wrapped onto each of the rollers 10. As illustrated in FIGS. 3 and 4, the two adjacent rollers 10 are positioned in closed proximity to each other such that a row of teeth 12 of each of the rollers 10 are interleaved with each other.

Figure 5:
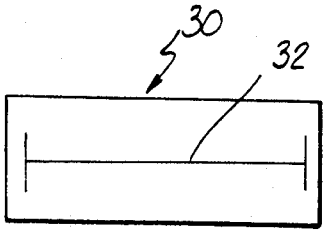
FIG. 5 is a plan view of an end paper fabricated to include a longitudinal I-shaped slot to accommodate a row of teeth of the perm rollers of FIGS. 1–4.

Referring now to FIG. 5, there is shown an end paper 30 fabricated in accordance with the present invention to include an I-shaped longitudinal slot opening 32 to accommodate a row of teeth 12 of a roller 10. End papers 30 may be fabricated of the same materials as prior art end papers employed during the application of conventional permanent wave hair treatments.

In using the permanent wave apparatus of the present invention, the beautician follows conventional prior art procedures to thoroughly cleanse the hair, following which a porosity equalizer may be applied, if desired. The hair is then sectioned as appropriate for wrap styling. The sections are divided into partings approximately 2½ inches wide by ¼ to ½ inch deep, depending on the texture and density of the hair. The partings are then held at a 90-degree angle from the scalp with one hand, while the other hand is used to palm a roller 10 with the rows of teeth 12 extending between the operator's fingers, the roller 10 being positioned at the base of the hair ends. By holding the roller 10 in this manner, the strands of hair will distribute themselves between the teeth 12, as long as the sections of hair are kept taut without stretching. One of the hooks 16 of an elastic end guard 14 is hooked over one end of the roller 10, after which the roller 10 is gradually slid toward the hair ends until only the very tips of the hair would be exposed after stretching the elastic end guard 14 across the roller 10. The remaining hook 16 of end guard 14 is then hooked over the opposite end of roller 10. Hair is then wound onto roller 10 evenly to the scalp, without crossing hair strands during rolling. The first one of rollers 10 used to begin wrapping a section of hair is then secured to the scalp by way of plastic slide clip 20. By leaving a ¼-inch gap at the hair root area, one of the clip members 22 of plastic slide clip 20 may be easily slid through the roller 10, while the other clip member 22 is positioned in the hair behind the curl, thereby providing additional lift to the hair roots, without imparting undue stress. Each subsequently wrapped one of rollers 10 employed to wrap a given section of hair is secured to an adjacent previously wrapped one of rollers 10 by way of one of the plastic slide clips 20, inserted into the two adjacent wrapped rollers 10, as illustrated in FIG. 4.

I claim:

1. A permanent wave apparatus for curling hair, the apparatus comprising in combination:

a plurality of rollers, each of the rollers being fabricated as a hollow cylinder having opposite ends, said cylinders each having a plurality of equally-spaced, longitudinally-aligned rows of outwardly protruding teeth on an outer surface of the cylinder and having a plurality of drainage apertures linearly arranged between said rows of teeth;

a plurality of elastic end guards, each of the elastic end guards being of flat cross section and having a length sufficient to permit it to be stretched between ends of one of said rollers, each of the elastic end guards including a hook at each end thereof to enable it to be hooked over the ends of one of said rollers;

a plurality of rectangular end papers for covering the loose ends of a parting of hair as it is being wrapped onto one of said rollers, each of said end papers being fabricated to include an I-shaped longitudinal slot opening for accommodating a row of teeth on said one of said rollers; and a plurality of plastic slide clips, each of said plastic slide clips being fabricated to be generally U-shaped with a pair of longitudinally extending clip members whose distal ends may be spread apart against a plastic spring force to an insertion position in which they are substantially parallel to each other for insertion into the cylindrical cavities of two adjacent ones of said rollers onto which hair has been wrapped, to thereby maintain the two rollers in an interlocked position.

2. A permanent wave apparatus as in claim 1 wherein each of said rollers has four equally-spaced, longitudinally-aligned rows of outwardly protruding teeth on the outer surface of the cylinder.

3. A permanent wave apparatus as in claim 2 wherein each of said rows of teeth comprises eleven teeth.

4. A permanent wave apparatus as in claim 2 wherein each of said rows of teeth comprises six teeth.

5. A permanent wave process for curling hair, the process comprising the steps of:

providing a plurality of rollers, each of the rollers being fabricated as a hollow cylinder having opposite ends, said cylinders each having a plurality of equally-spaced, longitudinally-aligned rows of outwardly protruding teeth on an outer surface of the cylinder and having a plurality of drainage apertures linearly arranged between said rows of teeth;

providing a plurality of elastic end guards, each of the elastic end guards being of flat cross section and having a length sufficient to permit it to be stretched between ends of one of said rollers, each of the elastic end guards including a hook at each end thereof to enable it to be hooked over the ends of one of said rollers;

providing a plurality of rectangular end papers, each of said end papers being fabricated to include an I-shaped longitudinal slot opening for accommodating a row of teeth on said one of said rollers;

providing a plurality of plastic slide clips, each of said plastic slide clips being fabricated to be generally U-shaped with a pair of longitudinally extending clip members whose distal ends may be spread apart against a plastic spring force to an insertion position in which they are substantially parallel to each other for insertion into the cylindrical cavities of two adjacent ones of said rollers;

sectioning the hair to be curled;

dividing a section of hair into partings;

laying the loose ends of a first parting over one of said rollers such that strands of hair at the loose ends of the parting distribute themselves between the teeth of one of the rows of teeth of the roller;

laying one of said end papers over the loose ends of the first parting such that the teeth of said one of the rows of teeth extend through said I-shaped slot opening in said end paper;

stretching and hooking said elastic end guard in position across said roller;

wrapping said first parting of hair onto said roller;

inserting one of said plastic slide clips such that one slide member is positioned in the cylindrical cavity of the roller and the other slide member is positioned in the hair between the roller and the scalp;

sequentially wrapping additional partings of the section of hair onto additional rollers; and inserting one of said plastic slide clips into the cylindrical cavities of each subsequently wrapped roller and a previously wrapped roller to thereby maintain adjacent pairs of rollers in an interlocked position.

* * * * *